US012336560B2

(12) United States Patent
Graf et al.

(10) Patent No.: US 12,336,560 B2
(45) Date of Patent: Jun. 24, 2025

(54) AEROSOL GENERATING ARTICLE WITH RETAINER

(71) Applicant: PHILIP MORRIS PRODUCTS S.A., Neuchatel (CH)

(72) Inventors: Didier Graf, Salvenach (CH); Michele Lorenzelli, Bologna (IT); Alexis Louvet, Lausanne (CH); Farhang Mohseni, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 391 days.

(21) Appl. No.: 17/632,257

(22) PCT Filed: Jul. 7, 2020

(86) PCT No.: PCT/EP2020/069135
§ 371 (c)(1),
(2) Date: Feb. 2, 2022

(87) PCT Pub. No.: WO2021/023454
PCT Pub. Date: Feb. 11, 2021

(65) Prior Publication Data

US 2022/0279838 A1 Sep. 8, 2022

(30) Foreign Application Priority Data

Aug. 2, 2019 (EP) ..... 19189914

(51) Int. Cl.
*A24D 1/22* (2020.01)
*A24C 5/01* (2020.01)
*A24D 1/02* (2006.01)

(52) U.S. Cl.
CPC ..... *A24D 1/22* (2020.01); *A24C 5/01* (2020.01); *A24D 1/02* (2013.01)

(58) Field of Classification Search
CPC ..... A24D 1/22; A24D 1/02; A24C 5/01
See application file for complete search history.

(56) References Cited

U.S. PATENT DOCUMENTS 4,819,665 A 4/1989 Roberts
5,040,552 A 8/1991 Schleich
(Continued)

FOREIGN PATENT DOCUMENTS

AU 580999 2/1989
CN 107920604 4/2018
(Continued)

OTHER PUBLICATIONS

Office Action issued in China for Application No. 202080050366.3 dated Aug. 29, 2023 (12 pages). English translation included.
(Continued)

*Primary Examiner* — Christopher M Rodd
*Assistant Examiner* — Jennifer A Kessie
(74) *Attorney, Agent, or Firm* — Mueting Raasch Group

(57) ABSTRACT

There is provided an aerosol generating article (2). The aerosol generating article comprises a combustible heat source (4) having a longitudinal outer surface, an aerosol-forming substrate (10) downstream of the combustible heat source, and a retaining wrap (35). The retaining wrap comprises a an upstream portion (31) extending at least about 50 percent of the way along the length of the combustible heat source on the longitudinal outer surface of the combustible heat source. The upstream portion of the retaining wrap comprises at least one opening (41, 42) overlaying at least about 30 percent of the longitudinal outer surface of the combustible heat source. The retaining wrap further comprises a downstream portion (33) circumscribing at least a portion of the aerosol-forming substrate.

14 Claims, 7 Drawing Sheets

(56) References Cited

U.S. PATENT DOCUMENTS

| | | | | |
|---|---|---|---|---|
| 5,595,577 | A | 1/1997 | Bensalem | |
| 9,788,571 | B2 | 10/2017 | Conner | |
| 11,096,413 | B2 | 8/2021 | Malgat | |
| 11,717,018 | B2 | 8/2023 | Nordskog | |
| 2018/0116275 | A1* | 5/2018 | Malgat | A24D 1/02 |
| 2019/0014813 | A1* | 1/2019 | Carraro | A24D 1/02 |

FOREIGN PATENT DOCUMENTS

| | | | |
|---|---|---|---|
| CN | 108882747 | 11/2018 | |
| EP | 0472367 | 3/1996 | |
| EP | 3346857 | 7/2018 | |
| EP | 3160275 | 8/2018 | |
| WO | WO 2009/022232 | 2/2009 | |
| WO | WO 2011/028372 | 3/2011 | |
| WO | WO 2011/045066 | 4/2011 | |
| WO | WO 2012/164077 | 12/2012 | |
| WO | WO 2013/120849 | 8/2013 | |
| WO | WO 2013/149810 | 10/2013 | |
| WO | WO 2015/197850 | 12/2015 | |
| WO | WO 2017/114683 | 7/2017 | |
| WO | WO 2017/115188 | 7/2017 | |
| WO | WO-2017114683 A1 * | 7/2017 | A24D 1/02 |

OTHER PUBLICATIONS

Extended European Search Report for Application No. 19189914.5 dated Feb. 17, 2020 (7 pages).
PCT International Search Report and Written Opinion for PCT/EP2020/069135 dated Sep. 28, 2020 (10 pages).

* cited by examiner

AEROSOL GENERATING ARTICLE WITH RETAINER

This application is a U.S. National Stage Application of International Application No. PCT/EP2020/069135 filed Jul. 7, 2020, which was published in English on Feb. 11, 2021, as International Publication No. WO 2021/023454 A1. International Application No. PCT/EP2020/069135 claims priority to European Application No. 19189914.5 filed Aug. 2, 2019.

The present invention relates to an aerosol generating article. In particular, the present invention relates to an aerosol generating article comprising a combustible heat source, an aerosol-forming substrate downstream of the combustible heat source, and a retaining wrap configured to join the combustible heat source and the aerosol-forming substrate. The present invention also relates to a method for forming an aerosol generating article.

A number of alternative aerosol generating articles have been proposed in the art. One aim of such alternative aerosol generating articles is to reduce the amount of certain smoke constituents of the type produced by the combustion and pyrolytic degradation of tobacco in combustible cigarettes. In one known type of aerosol generating article, an aerosol is generated by the transfer of heat from a combustible heat source to an aerosol-forming substrate located adjacent to the combustible heat source. During aerosol generation, volatile compounds are released from the aerosol-forming substrate by heat transfer from the combustible heat source and entrained in air drawn through the aerosol generating article. As the released compounds cool, they condense to form an aerosol. These are sometimes known as heated aerosol generating articles.

In heated aerosol generating articles which comprise a combustible heat source and an aerosol-forming substrate, the combustible heat source must be securely attached to the rest of the aerosol generating article. The combustible heat source must remain securely attached to the aerosol-forming substrate from manufacture and during the transport, use, and sometimes disposal of the aerosol generating article.

Combustible heat sources of the type used in aerosol generating articles may become damaged before or during use. For example, certain combustible heat sources may be fragile. Fragile combustible heat sources may be vulnerable to damage, for example cracking or chipping, prior to, or during, use. Some combustible heat sources comprise carbon. Combustible heat sources comprising carbon may be brittle which may make them particularly prone to damage. Additionally, some combustible heat sources are formed using powder processing techniques, these techniques may lead to combustible heat sources which are prone to damage. Damage to the combustible heat source during use can lead to material breaking off of the combustible heat source. This may result in less fuel to combust when the aerosol generating article is used. This may affect the amount of heat transferred from the combustible heat source to the aerosol-forming substrate and may therefore affect the release of volatile compounds from the aerosol-forming substrate. Additionally, material broken off of the combustible heat source may create an unacceptable mess and may affect the appearance of the combustible heat source.

In use the combustible heat source is ignited and combusted to generate heat which is transferred to the aerosol-forming substrate. To allow ignition and efficient combustion of the combustible heat source, the combustible heat source must have a good supply of air.

It may be desirable to provide an aerosol generating article with improved retention of the combustible heat source. It may also be desirable to provide an aerosol generating article which prevents the loss of material from the combustible heat source caused by damage to the combustible heat source. It may also be desirable to provide an aerosol generating article which allows sufficient air to access the combustible heat source for the efficient ignition and combustion of the combustible heat source.

According to the present invention, there is provided an aerosol generating article comprising a combustible heat source having a longitudinal outer surface, an aerosol-forming substrate downstream of the combustible heat source, and a retaining wrap.

The retaining wrap may comprise an upstream portion extending at least about 50 percent of the way along the length of the combustible heat source on the longitudinal outer surface. This may advantageously improve the retention of the combustible heat source to the aerosol-forming substrate.

The upstream portion of the retaining wrap may comprise at least one opening. This may advantageously allow sufficient air to reach the combustible heat source to facilitate ignition and combustion of the combustible heat source. The provision of at least one opening allows the retaining wrap to extend further towards the upstream end of the combustible heat source. This may advantageously improve retention of the combustible heat source to the aerosol-forming substrate while still allowing sufficient air to reach the combustible heat source to facilitate easy and rapid ignition with a conventional yellow flame cigarette lighter. Sufficient air may also be able to reach the combustible heat source to facilitate sustained combustion of the combustible heat source.

The at least one opening may overlay at least about 30 percent of the longitudinal outer surface of the combustible heat source. This may advantageously ensure that the at least one opening is large enough to allow sufficient air to reach the combustible heat source to facilitate ignition and combustion of the combustible heat source.

The retaining wrap may comprise a downstream portion circumscribing at least a portion of the aerosol-forming substrate. This may advantageously further improve the retention of the combustible heat source to the aerosol-forming substrate. Additionally, where the retaining wrap comprises heat conducting material, this provision may facilitate heat transfer from the combustible heat source to the aerosol-forming substrate.

In a preferred embodiment of the present invention, there is provided an aerosol generating article comprising a combustible heat source having a longitudinal outer surface; an aerosol-forming substrate downstream of the combustible heat source; and a retaining wrap. The retaining wrap comprises an upstream portion extending at least about 50 percent of the way along the length of the combustible heat source on the longitudinal outer surface of the combustible heat source. The upstream portion of the retaining wrap comprises at least one opening. The at least one opening overlays at least about 30 percent of the longitudinal outer surface of the combustible heat source. The retaining wrap further comprises a downstream portion circumscribing at least a portion of the aerosol-forming substrate.

The retaining wrap is configured to join the combustible heat source to the aerosol-forming substrate. The provision of a retaining wrap having an upstream portion about the combustible heat source, and a downstream potion about the aerosol-forming substrate advantageously improves the retention of the combustible heat source to the aerosol-forming substrate.

The provision of the upstream portion of the retaining wrap extending at least about 50 percent of the way along the length of the combustible heat source on the longitudinal outer surface of the combustible heat source may advantageously allow the combustible heat source to be held by the retaining wrap along a large portion of its length. This may advantageously improve the retention of the combustible heat source to the aerosol-forming substrate. This provision may also help to retain a greater proportion of any material formed by damage to the combustible heat source. This may advantageously prevent loss of material formed by damage to the combustible heat source. The present inventors have found that a greater coverage of the combustible heat source by the retaining wrap, may improve the retention of material formed by damage to the combustible heat source.

The upstream portion of the retaining wrap may extend at least about 60 percent, at least about 70 percent, at least about 80 percent, at least about 90 percent, or at least about 95 percent of the way along the length of the combustible heat source on the longitudinal outer surface of the combustible heat source.

In other words, upstream portion of the retaining wrap may extend between about 50 percent and about 100 percent, about 60 percent and about 100 percent, about 70 percent and about 100 percent, about 80 percent and about 100 percent, about 90 percent and about 100 percent, or about 95 percent to about 100 percent of the way along the length of the combustible heat source on the longitudinal outer surface of the combustible heat source.

The upstream portion of the retaining wrap may extend beyond the upstream end of the combustible heat source. It is understood that the term "extends beyond" means that the retaining wrap extends upstream of the upstream end of the combustible heat source. For example, the upstream portion of the retaining wrap may extend about 1 millimetre upstream of the upstream end of the combustible heat source.

The upstream end of the retaining wrap may be located some distance from the upstream end of the combustible heat source.

The provision of the upstream end of the retaining wrap located some distance from the upstream end of the combustible heat source may advantageously facilitate ignition of the combustible heat source since it leaves a portion of the upstream end of the combustible heat source exposed for ignition by an external heat source.

The upstream portion of the retaining wrap may extend no more than about 95 percent, about 90 percent, about 80 percent, about 70 percent, or about 60 percent of the way along the length of the combustible heat source on the longitudinal outer surface of the combustible heat source. This provision may advantageously improve the retention of the combustible heat source by the retaining wrap. This provision may also advantageously prevent loss of material from the combustible heat source caused by potential damage to the combustible heat source.

The upstream portion of the retaining wrap may extend between about 50 percent and about 95 percent, between about 60 percent and about 90 percent, or between about 70 percent and about 80 percent of the way along the length of the combustible heat source on the longitudinal outer surface of the combustible heat source.

The provision of the upstream portion of the retaining wrap including at least one opening overlaying at least about 30 percent of the longitudinal outer surface of the combustible heat source may allow sufficient air to reach the combustible heat source to facilitate ignition and combustion of the combustible heat source. The provision of the upstream portion of the retaining wrap including at least one opening overlaying at least about 30 percent of the longitudinal outer surface of the combustible heat source may allow the combustible heat source to be ignited by heat, such as a flame, passing through the at least one opening in the upstream portion of the retaining wrap to the combustible heat source. This may advantageously allow for easy and rapid ignition with a conventional yellow flame cigarette lighter and more complete combustion of the combustible heat source compared to examples which do not include at least one opening in the retaining wrap and therefore only allow for ignition at the upstream end of the combustible heat source beyond the upstream end of the retaining wrap.

The upstream portion of the retaining wrap includes at least one opening overlaying at least about 30 percent of the longitudinal outer surface of the combustible heat source. In other words, at least about 30 percent of the longitudinal outer surface of the combustible heat source will not be covered by the retaining wrap and will instead be exposed through the at least one opening. The at least one opening is configured such that the portion of the longitudinal outer surface of the combustible heat source exposed through the at least one opening accounts for at least about 30 percent of the total longitudinal outer surface of the combustible heat source. As set out below, the term "opening" will be understood to refer both to openings in the retaining wrap surrounded on all sides by the retaining wrap, and to openings which extend all the way to the upstream end of the retaining wrap such that the upstream edge of the retaining wrap defines a portion of the at least one opening.

The at least one opening in the upstream potion of the retaining wrap may overlay at least about 40 percent, at least about 50 percent, or at least about 60 percent of the of the longitudinal outer surface of the combustible heat source.

The at least one opening in the upstream portion of the retaining wrap may overlay less than 100 percent of the longitudinal outer surface of the combustible heat source. For example, the at least one opening in the upstream portion of the retaining wrap may overlay less than 90 percent, less than 80 percent, or less than 70 percent of the longitudinal outer surface of the combustible heat source.

The at least one opening in the upstream portion of the retaining wrap may overlay between about 40 percent and about 90 percent, between about 50 percent and about 80 percent, or between about 60 percent and about 70 percent of the longitudinal outer surface of the combustible heat source. Preferably, the at least one opening in the upstream portion of the retaining wrap may overlay about 65 percent of the longitudinal outer surface of the combustible heat source.

More preferably, where the at least one opening in the upstream portion of the retaining wrap overlays about 65 percent of the longitudinal outer surface of the combustible heat source, the upstream portion of the retaining wrap extends to the upstream end of the combustible heat source.

The provision of the downstream portion of the retaining wrap circumscribing at least a portion of the aerosol-forming substrate may further improve the retention of the combustible heat source to the aerosol-forming substrate since a large surface area of the retaining wrap is in contact with the outer surface of the aerosol-forming substrate. Furthermore, as discussed further below, the provision of the downstream portion of the retaining wrap circumscribing at least a portion of the aerosol-forming substrate may improve heat conduction between the combustible heat source and the aerosol-forming substrate where the retaining wrap comprises a heat conductive material. The provision of the downstream portion of the retaining wrap circumscribing at least a portion of the aerosol-forming substrate may advantageously ensure uniform heat transfer from the combustible heat source to the aerosol-forming substrate where the retaining wrap comprises heat conductive material.

The downstream portion of the retaining wrap may circumscribe at least about 60 percent, at least about 70 percent, at least about 80 percent, at least about 90 percent, or at least about 95 percent of the length of the aerosol-forming substrate. The downstream portion of the retaining wrap may circumscribe the entire length of the aerosol-forming substrate.

The downstream portion of the retaining wrap may extend beyond the downstream end of the aerosol-forming substrate. Where this is the case, the downstream portion of the retaining wrap may be used to securely attach the combustible heat source and the aerosol-forming substrate to further components of the aerosol generating article. Further possible components of the aerosol generating article are discussed below. The downstream portion of the retaining wrap may extend to the downstream end of the combustible heat source such that it wraps all the components of the aerosol generating article between the downstream end of the combustible heat source and the downstream end of the aerosol generating article.

The inventors of the present invention have identified the that it may be desirable to ensure secure attachment of the combustible heat source to the aerosol-forming substrate. The inventors of the present invention have also identified that it may be desirable to prevent loss of material from the combustible heat source caused by damage to the combustible heat source. The inventors have identified that these problems may be solved by providing a retaining wrap having an upstream portion, extending at least about 50 percent of the way along the length of the combustible heat source on the longitudinal outer surface and circumscribing at least a portion of the aerosol-forming substrate, and a downstream portion, circumscribing at least a portion of the aerosol-forming substrate. The retaining wrap may securely attach the combustible heat source to the aerosol-forming substrate. As set out below, in order to ensure retention of the combustible heat source, or retention of material formed by damage to the combustible heat source, the inventors have identified that the retaining wrap should extend at least about 50 percent of the way along the length of the combustible heat source. However, the inventors of the present invention have identified that a retaining wrap extending this far along the length of the combustible heat source may disadvantageously lead to a reduction in the amount of air which may reach the combustible heat source. This may inhibit ignition and sustained or complete combustion of the combustible heat source. The inventors of the present invention have identified that the provision of at least one opening in the upstream portion of the retaining wrap advantageously allows sufficient air to reach the combustible heat source, while at same time allowing the retaining wrap to extend along a considerable length of the combustible heat source thereby ensuring retention of the combustible heat source or retention of material formed by damage to the combustible heat source. In particular, the inventors of the present invention have established that to allow sufficient air to reach the combustible heat source, the at least one opening should overlay at least about 30 percent of the longitudinal surface of the combustible heat source.

As set out in more detail below, the at least one opening included in the retaining wrap may have any shape and size. Due to the at least one opening included in the retaining wrap, aerosol generating articles are conceivable where the retaining wrap does not circumscribe the combustible heat source. This may be the case where the portion of the retaining wrap extending across the outer surface of the combustible heat source is provided as a plurality of fingers.

The combustible heat source has a longitudinal outer surface.

As used herein with reference to the invention, the terms "longitudinal" and "axial" are used to describe the direction between the opposed upstream and downstream ends of the aerosol generating article, or of a component of the aerosol generating article. The "longitudinal outer surface" is therefore the outer surface of a component of the aerosol generating article which extends between opposed upstream and downstream ends of the component of the aerosol generating article.

As used herein with reference to the invention, the terms "circumscribe" and "circumscribing" refers to a first feature extending around the entire circumference of a second feature. For example, in the present invention the downstream portion of the retaining wrap circumscribes at least a portion of the aerosol-forming substrate. This means that at one or more points along the longitudinal length of the aerosol-forming substrate, the downstream portion of the retaining wrap extends around the entire circumference of the aerosol-forming substrate.

As used herein with reference to the invention, the terms "upstream" and "front", and "downstream" and "rear", are used to describe the relative positions of components, or portions of components, of the aerosol generating article in relation to the direction in which airflows through the aerosol generating article during use thereof. Aerosol generating articles according to the invention comprise a proximal end through which, in use, an aerosol exits the article for delivery to a user. The proximal end of the aerosol generating article may also be referred to as the mouth end or the downstream end. In use, a user draws on the mouth end of the aerosol generating article. The mouth end is downstream of the distal end. The combustible heat source is located at or proximate to the distal end. The distal end of the aerosol generating article may also be referred to as the upstream end. Components, or portions of components, of the smoking article may be described as being upstream or downstream of one another based on their relative positions between the proximal end of the smoking article and the distal end of the smoking article. The front of a component, or portion of a component, of the aerosol generating article is the portion at the end closest to the upstream end of the aerosol generating article. The rear of a component, or portion of a component, of the aerosol generating article is the portion at the end closest to the downstream end of the aerosol generating article. The rear portion of the combustible heat source is the portion of the combustible heat source at the downstream end of the combustible heat source. The front portion of the aerosol-forming substrate is the portion of the aerosol-forming substrate at the upstream end of the aerosol-forming substrate.

The upstream portion of the retaining wrap may extend to the upstream end of the combustible heat source.

This may advantageously further improve retention of the combustible heat source to the aerosol-forming substrate. This provision may also help to retain a greater proportion of any material formed by damage to the combustible heat source. The upstream end of the combustible heat source, and in particular the upstream edge portion of the combustible heat source, may be particularly susceptible to damage due to chipping. The provision of providing retaining wrap up to the upstream end of the combustible heat source may advantageously improve retention of material formed by damage to the combustible heat source at the upstream end of the combustible heat source.

The combustible heat source may comprise an upstream planar end face at the upstream end of the combustible heat source.

Where the combustible heat source comprises an upstream planar end face at the upstream end of the combustible heat source, the retaining wrap may extend over at least a portion of the planar end face of the combustible heat source.

This may advantageously further improve retention of the combustible heat source to the aerosol-forming substrate. This may advantageously further improve retention of material formed by damage to the combustible heat source Where the combustible heat source comprises an upstream planar end face at the upstream end of the combustible heat source, the retaining wrap may not extend over at least a portion of the planar end face of the combustible heat source. In other words, the upstream planar end surface of the combustible heat source may be exposed.

This may advantageously improve ignition and combustion of the combustible heat source by allowing air to reach the combustible heat source.

Where the upstream portion of the retaining wrap extends to the upstream end of the combustible heat source, the at least one opening may preferably overlay at least about 50 percent of the longitudinal outer surface of the combustible heat source. This may advantageously expose a sufficient area of the combustible heat source to facilitate easy and rapid ignition with a conventional yellow flame cigarette lighter. Sufficient air may also be able to reach the combustible heat source to facilitate sustained combustion of the combustible heat source.

The at least one opening of the upstream portion of the retaining wrap may have a total area of at least about 45 millimetres squared. In other words, at least about 45 millimetres squared of the longitudinal outer surface of the combustible heat source will not be covered by the retaining wrap and will instead be exposed through the at least one opening.

This may advantageously allow for sufficient air to access the combustible heat source for the efficient ignition and combustion of the combustible heat source. The provision of the upstream portion of the retaining wrap including at least one opening having a total area of at least about 45 millimetres squared may allow the combustible heat source to be ignited by heat, such as a flame, passing through the at least one opening in the upstream portion of the retaining wrap to the combustible heat source. This may allow for easy and rapid ignition with a conventional yellow flame cigarette lighter and more complete combustion of the combustible heat source compared to examples which do not include at least one opening in the retaining wrap and therefore only allow for ignition at the upstream end of the combustible heat source beyond the upstream end of the retaining wrap. The provision of the upstream portion of the retaining wrap including at least one opening having a total area of at least about 45 millimetres squared may also allow the retaining wrap to extend further towards the upstream end of the combustible heat source. This may advantageously improve retention of the combustible heat source to the aerosol-forming substrate while still allowing sufficient air to reach the combustible heat source to facilitate easy and rapid ignition with a conventional yellow flame cigarette lighter and sustained combustion of the combustible heat source.

The at least one opening of the retaining wrap may have a total area of at least about 60 millimetres squared, at least about 80 millimetres squared, at least about 100 millimetres squared, or at least about 120 millimetres squared.

The at least one opening of the retaining wrap may have a total area of less than about 180 millimetres squared, less than about 140 millimetres squared, less than about 120 millimetres squared.

The at least one opening of the retaining wrap may have a total area of between about 60 millimetres squared and about 180 millimetres squared, or between about 80 millimetres squared and about 140 millimetres squared. Preferably, the at least one opening of the retaining wrap may have a total area of between about 90 millimetres squared and about 110 millimetres squared. More preferably, the at least one opening of the retaining wrap may have a total area of about 96 millimetres squared.

The at least one opening of the upstream portion of the retaining wrap may comprise an opening having an area of at least about 45 millimetres squared, at least about 48 millimetres squared or at least about 55 millimetres squared.

This may advantageously ensure that the at least one opening comprises an opening large enough to allow sufficient air to reach the combustible heat source to facilitate ignition and combustion of the combustible heat source.

Each of the at least one opening of the upstream portion of the retaining wrap may have an area of at least about 45 millimetres squared, at least about 48 millimetres squared or at least about 55 millimetres squared.

The at least one opening of the upstream portion of the retaining wrap may comprise a rectangular opening.

The at least one opening of the upstream portion of the retaining wrap may comprise an opening having a constant width along the entire length of the opening.

The opening may have a width of between about 4 millimetres and about 16 millimetres, between about 6 millimetres and about 14 millimetres, or between about 8 millimetres and about 12 millimetres. Preferably, the opening has a width of about 10 millimetres.

The opening may have a length of between about 3 millimetres and 9 millimetres, or between about 4.5 millimetres and about 6 millimetres. The opening may have a length of about 4.5 millimetres. The opening may have a length of about 5.5 millimetres. The opening may have a length of about 6 millimetres.

The at least one opening of the upstream portion of the retaining wrap may comprise an opening comprising a narrow portion and a wider portion. The narrow portion may have a rectangular shape. The wider portion may have a rectangular shape.

The narrow portion of the opening may have a width of between about 0.5 millimetres and about 3.5 millimetres, between about 1 millimetre and about 3 millimetres, or between about 1.5 millimetres and about 2.5 millimetres. Preferably, the narrow portion of the opening has a width of about 2 millimetres.

The narrow portion of the opening may have a length of between about 0.5 millimetres and about 5 millimetres, between about 1 millimetre and about 5 millimetres, or between about 1 millimetre and about 3 millimetres. Preferably, the narrow portion of the opening has a length of about 1.5 millimetres.

The wider portion of the opening may have a width of between about 4 millimetres and about 16 millimetres, between about 6 millimetres and about 14 millimetres, or between about 8 millimetres and about 12 millimetres. Preferably, the wider portion of the opening has a width of about 10 millimetres.

The wider portion of the opening may have a length of between about 3 millimetres and about 7 millimetres, between about 4 millimetres and about 6 millimetres, or between about 4.5 millimetres and about 5.5 millimetres. The wider portion of the opening may have a length of about 4.5 millimetres. The wider portion of the opening may have a length of about 5.5 millimetres.

The narrow portion of the opening may be downstream of the wider portion of the opening. Alternatively, the narrow portion of the opening may be upstream of the wider portion of the opening.

As used herein with reference to the invention, the term "length" refers to the dimension of a feature, for example an opening or the combustible heat source, in the longitudinal direction of the aerosol generating article from the upstream end of the feature to the downstream end of the feature.

As used herein with reference to the invention, the term "width" refers to the dimension of a feature, for example an opening, in a direction perpendicular to the longitudinal direction of the aerosol generating article. In particular, it will be understood that where the aerosol generating article, or components of the aerosol generating article have curved surfaces, the "width" of features may follow a curved line over the contours of the surface of the aerosol generating article.

The retaining wrap may be adhered to the surface of the combustible heat source.

This may advantageously improve retention of the combustible heat source to the aerosol-forming substrate.

The upstream potion of the retaining wrap may be adhered to the surface of the combustible heat source using an adhesive. The adhesive may be any suitable adhesive. Preferably, the adhesive is a heat resistant adhesive. Preferably, the stable at the temperatures reached by the combustion of the combustible heat source. For example, the adhesive may be a silicate glue.

The adhesive may be provided between the combustible heat source and the upstream portion of the retaining wrap on only a portion of the combustible heat source.

The adhesive may be provided on only part of the upstream portion of the retaining wrap.

The part of the upstream portion of the retaining wrap may have any shape. For example, part of the upstream portion of the retaining wrap may be a longitudinal line, a transverse line, an oval, a spiral, a square, or dot. There may be a plurality of parts of the upstream portion of the retaining wrap. The plurality of parts of the upstream portion of the retaining wrap may comprise a plurality of longitudinal lines, a plurality of transverse lines, or a plurality of dots.

The adhesive may be provided on the entire upstream portion of the retaining wrap.

Alternatively, there retaining wrap may not be adhered to the surface of the combustible heat source.

This may advantageously simplify manufacture of the aerosol generating article. Where the retaining wrap is not adhered to the surface of the combustible heat source, the tight fit of the combustible heat source in the retaining wrap may be sufficient to retain the combustible heat source.

The downstream portion of the retaining wrap may be adhered to the surface of the aerosol-forming substrate.

The retaining wrap may comprise any suitable material. Preferably, the retaining wrap comprises a material which is heat resistant. Preferably, the retaining wrap comprises a thermally conductive material.

The retaining wrap may comprise a metallic foil. For example, the retaining wrap may comprise foil formed from aluminium (aluminium foil).

Advantageously, the use of metallic foil may ensure reliable retention of the combustible heat source to the aerosol-forming substrate even when the combustible heat source is ignited. The use of metallic foil may provide effective heat conduction from the combustible heat source to the aerosol-forming substrate. This may advantageously improve the generation of aerosol by the aerosol-forming substrate.

The metallic foil may have a thickness of at least about 5 micrometres. For example, the metallic foil may have a thickness of at least about 10 micrometres or at least about 15 micrometres. The metallic foil may have a thickness of no more than about 60 micrometres. For example, the metallic foil may have a thickens of no more than about 40 micrometres, no more than about 35 micrometres, no more than about 30 micrometres, or no more than about 25 micrometres.

The metallic foil may have a thickness of between about 5 micrometres and about 40 micrometres, between about 10 micrometres and about 35 micrometres, or between about 15 micrometres and about 25 micrometres. Preferably, the metallic foil may have a thickness of about 20 micrometres.

Preferably the metallic foil is provided in at least some portion of both the upstream portion of the retaining wrap and the downstream portion of the retaining wrap. This may advantageously improve heat conduction from the combustible heat source to the aerosol-forming substrate.

In some embodiments, both the upstream portion of the retaining wrap and the downstream portion of the retaining wrap comprise metallic foil, and the metallic foil circumscribes at least a portion of the aerosol-forming substrate.

The retaining wrap may comprise other materials in addition to metallic foil. Where this is the case, the metallic foil may be spaced radially closer or radially further from the combustible heat source than the other materials. Preferably, the metallic foil is provided closer to the surface of the combustible heat source than any of the other materials of the retaining wrap. This may advantageously allow the most effective heat conduction from the combustible heat source to the aerosol-forming substrate.

The retaining wrap may comprise paper.

Advantageously, the use of paper may give the exterior surface of the aerosol generating article the appearance and texture of conventional cigarettes. Additionally, the use of paper may simplify manufacturing of the aerosol generating article.

The paper may have a thickness of at least about 20 micrometres. For example, the paper may have a thickness of at least about 30 micrometres or at least about 40 micrometres.

The paper may have a thickness of no more than about 100 micrometres. For example, the paper may have a thickness of no more than about 80 micrometres, 70 micrometres, or no more than 60 micrometres.

The paper may have a thickness of between about 20 micrometres and about 100 micrometres, between about 30 micrometres and about 70 micrometres, or between about 40 micrometres and about 60 micrometres. Preferably, the paper has a thickness of about 50 micrometres.

The retaining wrap may comprise other materials in addition to the paper. For example, the retaining wrap may comprise a combination of paper and metallic foil. Where this is the case, the metallic foil may be attached to the paper using an adhesive. The adhesive may be sprayed or otherwise applied to the surface of the paper before the metallic foil is applied. Alternately, or in addition, the adhesive may be sprayed or otherwise applied to the surface of the metallic foil before the paper is applied. As set out above. Where the retaining wrap comprises both paper and metallic foil, it is advantageous for the metallic foil to be disposed radially closer to the combustible heat source than the paper.

Where the retaining wrap comprises a combination of paper and metallic foil, the paper and the metallic foil may extend over the same area of the combustible heat source.

Alternatively, the metallic foil may extend over a greater area of the longitudinal surface of the combustible heat source than the paper. In this case, preferably the paper and the metallic foil together extend over a downstream portion of the combustible heat source, while only the metallic foil extends further, over an upstream portion of the combustible heat source.

Alternatively, the paper may extend over a greater area of the longitudinal surface of the combustible surface of the combustible heat source than the metallic foil. In this case, preferably the paper and the metallic foil together extend over a downstream portion of the combustible heat source, while only the paper extends further, over an upstream portion of the combustible heat source.

For example, at least about 10 percent of the length of the upstream portion of the retaining wrap may comprise both paper and metallic foil. Preferably at least about 25 percent, at least about 50 percent, at least about 75 percent, or at least about 90 percent of the length of the upstream portion of the retaining wrap may comprise both paper and metallic foil. The remaining percentage of the length of the upstream portion of the retaining wrap may comprise only one of the paper or the metallic foil.

The upstream portion of the retaining wrap may comprise both paper and metallic foil while the downstream portion of the retaining wrap may comprise only paper.

The paper may comprise at least one of paper co-laminated with a metal or metalized paper.

Paper co-laminated with a metal may comprise a layer of paper with a layer of metal applied to a surface. The layer of metal may be applied to the paper using an adhesive.

Metalized paper may comprise a layer of paper with a layer of metal applied to a surface. The layer of metal may be applied, for example, by deposition. The layer of metal may comprise aluminium.

Where the paper comprises paper co-laminated with a metal or metalized paper, the metal component of the paper is distinct from the metal foil described above which may also form part of the retaining wrap.

Advantageously, paper co-laminated with a metal, or a metalized paper may exhibit greater temperature resistance compared to paper which is not co-laminated with a metal, or non-metalized paper.

The retaining wrap may have a maximum thickness of no more than about 190 micrometres. Where the retaining wrap comprises more than one component, this means that the total thickness of all of the components of the retaining wrap is no more than about 190 micrometres. For example, the retaining wrap may have a maximum thickness of no more than about 160 micrometres, no more than about 150 micrometres, no more than about 120 micrometres, no more than about 100 micrometres, or no more than about 80 micrometres.

The retaining wrap may have a maximum thickness of at least about 40 micrometres. For example, the retaining wrap may have a maximum thickness of at least about 50 micrometres, or at least about 60 micrometres.

The retaining wrap may have a thickness of about 70 micrometres.

The at least one opening in the retaining wrap may comprise an opening surrounded on all sides by the retaining wrap. Where this is the case, the at least one opening in the retaining wrap is defined on all sides by the retaining wrap. In other words, the opening surrounded on all sides by the retaining wrap may be an aperture through the material forming the retaining wrap.

The opening may have any shape. For example, the opening may have a shape including but not limited to, a circle, a square, a rectangle, a diamond, a spiral, and a hexagon. The shape of the opening may form a visible indicia on an outer surface of the wrapper.

As used herein with reference to the invention, the term "visible indicia" refers to a discrete element that provides an aesthetically pleasing, or informative, representation. The indicia may be in the form of text, images, letters, words, logos, or a combination thereof. The indicia may comprise a brand or manufacturer logo that allows the consumer to identify the type or origin of the aerosol generating article. The indicia may provide information to the user, for example informing the user that the aerosol generating article is ready for use. Light emitted from the combustible heat source during use may be visible through the opening. This may increase the visibility of the indicia. Moreover, a change in colour of the combustible heat source (for example, indicating that the combustible heat source has combusted) may be visible through the opening.

The provision of the at least one opening in the retaining wrap comprising an opening surrounded on all sides by the retaining wrap allows the upstream end of the retaining wrap to fully circumscribe a portion of the combustible heat source to form a complete ring of retaining wrap. This may advantageously improve the retention of the combustible heat source as it allows the retaining wrap to tightly hold the combustible heat source.

The upstream edge of the at least one opening may be disposed at least about 1 millimetre from the upstream end of the retaining wrap.

This may advantageously allow the complete ring of retaining wrap at the upstream end of the retaining wrap to have improved retention of the combustible heat source to the aerosol-forming substrate.

The upstream edge of the at least one opening may be disposed at least about 1.5 millimetres, at least about 2 millimetres, at least about 2.5 millimetres, or at least about 3 millimetres from the upstream end of the retaining wrap.

At least one opening may extend to the upstream end of the retaining wrap such that the at least one opening in the retaining wrap is not surrounded on all sides by the retaining wrap. Where this is the case, the at least one opening in the retaining wrap is defined on at least one side by the upstream end of the retaining wrap. Where this is the case, the retaining wrap may be provided as a plurality of fingers extending from the downstream end of the combustible heat source toward the upstream end of the combustible heat source.

This provision allows for a continuous air supply from the upstream end of the combustible heat source all the way to the downstream end of the at least one opening. This may advantageously allow for improved combustion of the combustible heat source.

Preferably, the downstream end of the at least one opening does not extend to the downstream end of the combustible heat source. The inventors have found that in some cases, openings which extend to the downstream end of the combustible heat source may be less effective at heating the aerosol-forming substrate. This may be because, where the retaining wrap comprises a heat conducting material, in these embodiments there is less heat conducting material at the downstream end of the combustible heat source to transfer heat from the combustible heat source to the aerosol-forming substrate. Preferably, the downstream end of the at least one opening is no closer than 1 millimetre, or no closer than 2 millimetres from the downstream end of the combustible heat source. In some particularly preferred embodiments, the downstream end of the at least one opening is about 3 millimetres from the downstream end of the combustible heat source.

Preferably, the upstream portion of the retaining wrap extends to the upstream end of the combustible heat source, the retaining wrap comprises both metallic foil, and paper co-laminated with a metal or metalized paper, and the at least one opening overlays between about 50 percent and about 90 percent of the longitudinal outer surface of the combustible heat source.

The at least one opening may comprise any number of openings. For example, the at least one opening may comprise 1, 2, 3, 4, 5, 10, or 20 openings. The at least one opening may comprise a combination of one or more openings which comprise an opening surrounded on all sides by the retaining wrap, and one or more openings which extend to the upstream end of the retaining wrap.

Preferably, the at least one opening consists of 2 openings. That is, the at least one opening consists of a first opening and a second opening. Preferably, the first opening and the second opening are evenly spaced about the combustible heat source.

The provision of a first and second opening evenly spaced about the combustible heat source may allow for air to access the combustible heat source uniformly. This may advantageously allow for the uniform combustion of the combustible heat source which in turn may lead to more uniform, efficient, and predictable heating of the aerosol-forming substrate.

Preferably, the second opening is about the same size and about the same shape as the first opening. This may advantageously simplify manufacture of the aerosol generating article whilst also allowing for air to access the combustible heat source more uniformly. This may advantageously further allow for the more uniform combustion of the combustible heat source which in turn may lead to more uniform, efficient and predictable heating of the aerosol forming substrate.

According to the present invention, there is further provided a method for forming an aerosol generating article. The method comprises providing a combustible heat source and an aerosol-forming substrate, providing a portion of wrapping material, and cutting at least one opening in the portion of wrapping material to form a retaining wrap. The method further comprises applying the retaining wrap to the combustible heat source and the aerosol-forming substrate. The retaining wrap may be applied to the combustible heat source and the aerosol-forming substrate such that, an upstream portion of the retaining wrap extends at least about 50 percent of the way along the length of the combustible heat source on the longitudinal outer surface of the combustible heat source. The retaining wrap may be applied to the combustible heat source and the aerosol-forming substrate such that the at least one opening is in the upstream portion of the retaining wrap, and a downstream portion of the retaining wrap circumscribes at least a portion of the aerosol-forming substrate.

Preferably, there is provided a method for forming an aerosol generating article. The method comprises providing a combustible heat source and an aerosol-forming substrate, providing a portion of wrapping material, and cutting at least one opening in the portion of wrapping material to form a retaining wrap. The method further comprises applying the retaining wrap to the combustible heat source and the aerosol-forming substrate such that, an upstream portion of the retaining wrap extends at least about 50 percent of the way along the length of the combustible heat source on the longitudinal outer surface of the combustible heat source, the at least one opening being in the upstream portion of the retaining wrap, and a downstream portion of the retaining wrap circumscribes at least a portion of the aerosol-forming substrate.

The provision of cutting the at least one opening in the portion of wrapping material to form a retaining wrap before applying the retaining wrap removes the need to cut the at least one opening in the wrapping material once the retaining wrap has been applied to the combustible heat source and the aerosol-forming substrate. This may advantageously simplify manufacture since it allows the opening to be provided in-line and when the wrapping material is flat rather than when it is wrapped around the combustible heat source and the aerosol-forming substrate. In addition, this may advantageously provide a method of manufacture that presents a lower risk of damaging the combustible heat source during creation of the at least one opening in the retaining wrap. This may in turn lead to lower rejection rates of aerosol generating articles.

The retaining wrap may be applied to the combustible heat source such that the at least one opening overlays at least about 30 percent of the longitudinal outer surface of the combustible heat source.

The method may further comprise steps of adding further components to the aerosol-generating article. For example, the method may comprise adding one or more of, an aerosol cooling element, a transfer element, and a mouthpiece comprising a filter to the aerosol generating article. Where the retaining wrap extends to the downstream end of the aerosol generating article, the retaining wrap may be applied to all of the additional components. Alternatively, once the retaining wrap is applied to the combustible heat source and the aerosol-forming substrate, an overwrap may be applied to join the combustible heat source and the aerosol-forming substrate to the other components of the aerosol generating article.

The step of providing a portion of retention wrap may comprise: providing a portion of paper co-laminated with a metal, or metallized paper; providing a portion of metallic foil, and affixing the portion of metallic foil to the portion of paper.

The portion of metallic foil may be affixed to the portion of paper using an adhesive. The method may comprise spraying or lining an adhesive onto the portion of paper before then applying the portion of metallic foil to the adhesive. The portion of metallic foil may be an aluminium patch.

The step of cutting at least one opening in the portion of wrapping material may comprise cutting a single opening through both; the portion of paper co-laminated with a metal, or metallized paper, and the portion of metallic foil.

The step of cutting the at least one opening in the portion of wrapping material may be performed one or more of; a stamp, a laser, a u-knife, or a combination of knives as needed to provide the required shape.

Aerosol generating articles according to the present invention comprise a combustible heat source for heating the aerosol-forming substrate. The combustible heat source is preferably a solid heat source, and may comprise any suitable combustible fuel including, but not limited to, carbon and carbon-based materials containing aluminium, magnesium, one or more carbides, one or more nitrides and combinations thereof. Solid combustible heat sources for heated smoking articles and methods for producing such heat sources are known in the art and described in, for example, U.S. Pat. Nos. 5,040,552 and 5,595,577. Typically, known solid combustible heat sources for heated smoking articles are carbon-based, that is they comprise carbon as a primary combustible material.

The combustible heat source may be a combustible carbonaceous heat source.

The combustible heat source is preferably a blind combustible heat source.

As used herein with reference to the invention, the term "blind" describes a heat source that does not comprise any airflow channels extending from the front end face to the rear end face of the combustible heat source. As used herein with reference to the invention, the term "blind" is also used to describe a combustible heat source including one or more channels extending from the front end face of the combustible heat source to the rear end face of the combustible heat source, wherein a combustible substantially air impermeable barrier between the rear end face of the combustible heat source and the aerosol-forming substrate barrier prevents air from being drawn along the length of the combustible heat source through the one or more channels.

The inclusion of one or more closed air passageways increases the surface area of the blind combustible heat source that is exposed to oxygen from the air and may advantageously facilitate ignition and sustained combustion of the blind combustible heat source.

Aerosol generating articles according to the invention comprising blind combustible heat sources comprise one or more air inlets downstream of the rear end face of the combustible heat source for drawing air into one or more airflow pathways through the aerosol generating article. Aerosol generating articles according to the invention comprising non-blind combustible heat sources may also comprise one or more air inlets downstream of the rear end face of the combustible heat source for drawing air into one or more airflow pathways through the aerosol generating article. Where the aerosol generating article comprises one or more air inlets downstream of the rear end face of the combustible heat source, the one or more air inlets may be in the downstream portion of the retaining wrap. Alternatively, the one or more air inlets downstream of the rear end face of the combustible heat source may be further downstream than the downstream end of the downstream portion of the retaining wrap.

In some embodiments, aerosol generating articles according to the invention comprising blind combustible heat sources comprise one or more air inlets located proximate to the downstream end of the aerosol-forming substrate.

In use, air drawn along the one or more airflow pathways of aerosol generating articles according to the invention comprising a blind combustible heat source does not pass through any airflow channels along the blind combustible heat source. The lack of any airflow channels through the blind combustible heat source advantageously substantially prevents or inhibits activation of combustion of the blind combustible heat source during puffing by a user. This substantially prevents or inhibits spikes in the temperature of the aerosol-forming substrate during puffing by a user. By preventing or inhibiting activation of combustion of the blind combustible heat source, and so preventing or inhibiting excess temperature increases in the aerosol-forming substrate, combustion or pyrolysis of the aerosol-forming substrate under intense puffing regimes may be advantageously avoided. In addition, the impact of a user's puffing regime on the composition of the mainstream aerosol may be advantageously minimised or reduced.

The inclusion of a blind combustible heat source may also advantageously substantially prevent or inhibit combustion and decomposition products and other materials formed during ignition and combustion of the blind combustible heat source from entering air drawn through aerosol generating articles according to the invention during use thereof. This is particularly advantageous where the blind combustible heat source comprises one or more additives to aid ignition or combustion of the blind combustible heat source.

In aerosol generating articles according to the invention comprising a blind combustible heat source, heat transfer from the blind combustible heat source to the aerosol-forming substrate occurs primarily by conduction. Heating of the aerosol-forming substrate by forced convection is minimised or reduced. This may advantageously help to minimise or reduce the impact of a user's puffing regime on the composition of the mainstream aerosol of articles according to the invention.

In aerosol generating articles according to the invention comprising a blind combustible heat source, it is particularly important to optimise the conductive heat transfer between the combustible heat source and the aerosol-forming substrate. As described further below, the inclusion of one or more heat-conducting elements around at least a rear portion of the combustible carbonaceous heat source and at least a front portion of the aerosol-forming substrate is particularly preferred in aerosol generating articles according to the invention including blind heat sources, where there is little if any heating of the aerosol-forming substrate by forced convection.

In certain embodiments of the invention, the combustible heat source comprises at least one longitudinal airflow channel, which provides one or more airflow pathways through the heat source. The term "airflow channel" is used herein to describe a channel extending along the length of the heat source through which air may be drawn through the aerosol generating article. Such heat sources including one or more longitudinal airflow channels are referred to herein as "non-blind" heat sources.

The diameter of the at least one longitudinal airflow channel may be between about 1.5 millimetres and about 3 millimetres, more preferably between about 2 millimetres and about 2.5 millimetres. The inner surface of the at least one longitudinal airflow channel may be partially or entirely coated, as described in more detail in WO-A-2009/022232.

Preferably, the combustible heat source has a length of between about 7 millimetres and about 17 millimetres, more preferably of between about 7 millimetres and about 15 millimetres, most preferably of between about 7 millimetres and about 13 millimetres. In some embodiments, the combustible heat source has a length of about 9 millimetres.

Preferably, the combustible heat source has a diameter of between about 5 millimetres and about 9 millimetres, more preferably of between about 7 millimetres and about 8 millimetres.

As used herein with reference to the invention, the term "aerosol-forming substrate" is used to describe a substrate capable of releasing upon heating volatile compounds, which can form an aerosol. The aerosols generated from aerosol-forming substrates of aerosol generating articles according to the invention may be visible or invisible and may include vapours (for example, fine particles of substances, which are in a gaseous state, that are ordinarily liquid or solid at room temperature) as well as gases and liquid droplets of condensed vapours.

The aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds, which are released from the substrate upon heating. Alternatively, the aerosol-forming substrate may comprise a non-tobacco material. The aerosol-forming substrate may further comprise one or more aerosol formers. Examples of suitable aerosol formers include, but are not limited to, glycerine and propylene glycol.

The aerosol-forming substrate may be a rod comprising a tobacco-containing material.

If the aerosol-forming substrate is a solid aerosol-forming substrate, the solid aerosol-forming substrate may comprise, for example, one or more of: powder, granules, pellets, shreds, spaghetti strands, strips or sheets containing one or more of: herb leaf, tobacco leaf, fragments of tobacco ribs, reconstituted tobacco, homogenised tobacco, extruded tobacco and expanded tobacco. The solid aerosol-forming substrate may be in loose form, or may be provided in a suitable container or cartridge. For example, the aerosol-forming material of the solid aerosol-forming substrate may be contained within a paper or other wrapper and have the form of a plug. Where an aerosol-forming substrate is in the form of a plug, the entire plug including any wrapper is considered to be the aerosol-forming substrate.

Optionally, the solid aerosol-forming substrate may contain additional tobacco or nontobacco volatile flavour compounds, to be released upon heating of the solid aerosol-forming substrate. The solid aerosol-forming substrate may also contain capsules that, for example, include the additional tobacco or non-tobacco volatile flavour compounds and such capsules may melt during heating of the solid aerosol-forming substrate.

Optionally, the solid aerosol-forming substrate may be provided on or embedded in a thermally stable carrier. The carrier may take the form of powder, granules, pellets, shreds, spaghetti strands, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

The aerosol-forming substrate may be in the form of a plug or segment comprising a material capable of emitting volatile compounds in response to heating circumscribed by a paper or other wrapper. Where an aerosol-forming substrate is in the form of such a plug or segment, the entire plug or segment including any wrapper is considered to be the aerosol-forming substrate.

The aerosol-forming substrate preferably has a length of between about 5 millimetres and about 20 millimetres. In certain embodiments, the aerosol-forming substrate may have a length of between about 6 millimetres and about 15 millimetres or a length of between about 7 millimetres and about 12 millimetres.

The aerosol-forming substrate may comprise a plug of tobacco-based material wrapped in a plug wrap. In preferred embodiments, the aerosol-forming substrate comprises a plug of homogenised tobacco-based material wrapped in a plug wrap.

In any of the above embodiments, the combustible heat source and the aerosol-forming substrate may be in abutting coaxial alignment. As used herein with reference to the invention, the terms "abutting" and "abut" are used to describe a component, or a portion of a component, being in direct contact with another component, or portion of a component. This includes embodiments in which the combustible heat source comprises a non-combustible barrier between its downstream face and the aerosol-forming substrate, the non-combustible barrier being in direct contact with the aerosol-forming substrate.

Aerosol generating articles according to the invention may comprise a heat-conducting element around and in direct contact with both at least a rear portion of the combustible heat source and at least a front portion of the aerosol-forming substrate. In such embodiments, the heat-conducting element provides a thermal link between the combustible heat source and the aerosol-forming substrate of aerosol generating articles according to the invention and advantageously helps to facilitate adequate heat transfer from the combustible heat source to the aerosol-forming substrate to provide an acceptable aerosol.

Aerosol generating articles according to the invention may comprise a heat-conducting element spaced apart from one or both of the combustible heat source and the aerosol-forming substrate, such that there is no direct contact between the heat-conducting element and one or both of the combustible heat source and the aerosol-forming substrate.

Where the aerosol generating article comprises a heat-conducting element around at least a rear portion of the combustible heat source and at least a front portion of the aerosol-forming substrate, the heat-conducting element may be formed by the retaining wrap. For example, the retaining wrap may comprise one or more layers of heat conductive material which form the one or more heat-conducting elements.

The heat-conducting element is preferably non-combustible. In certain embodiments, the heat-conducting element may be oxygen restricting. In other words, the one or more heat-conducting elements may inhibit or resist the passage of oxygen through the heat-conducting element.

Suitable heat-conducting elements include, but are not limited to: metal foil wrappers such as, for example, aluminium foil wrappers, steel wrappers, iron foil wrappers and copper foil wrappers; and metal alloy foil wrappers.

Aerosol generating articles according to the invention may comprise a transfer element, or spacer element, downstream of the aerosol-forming substrate. Such an element may take the form of a hollow tube that is located downstream of an aerosol-forming substrate.

The transfer element may abut one or both of the aerosol-forming substrate and a mouthpiece. Alternatively, the transfer element may be spaced apart from one or both of the aerosol-forming substrate and the mouthpiece.

The inclusion of a transfer element advantageously allows cooling of the aerosol generated by heat transfer from the combustible heat source to the aerosol-forming substrate. The inclusion of a transfer element also advantageously allows the overall length of the aerosol generating article to be adjusted to a desired value, for example to a length similar to that of a conventional cigarette, through an appropriate choice of the length of the transfer element.

The transfer element may have a length of between about 7 millimetres and about 50 millimetres, for example a length of between about 10 millimetres and about 45 millimetres or of between about 15 millimetres and about 30 millimetres. The transfer element may have other lengths depending upon the desired overall length of the aerosol generating article, and the presence and length of other components within the aerosol generating article.

Preferably, the transfer element comprises at least one open-ended tubular hollow body. In such embodiments, in use, air drawn into the aerosol generating article passes through the at least one open-ended tubular hollow body as it passes downstream through the aerosol generating article from the aerosol-forming substrate to the distal end of the aerosol generating article.

The transfer element may comprise at least one open-ended tubular hollow body formed from one or more suitable materials that are substantially thermally stable at the temperature of the aerosol generated by the transfer of heat from the combustible heat source to the aerosol-forming substrate. Suitable materials are known in the art and include, but are not limited to, paper, cardboard, plastics, such a cellulose acetate, ceramics and combinations thereof.

Aerosol generating articles according to the invention may comprise an aerosol-cooling element or heat exchanger downstream of the aerosol-forming substrate. The aerosol-cooling element may comprise a plurality of longitudinally extending channels. Where the aerosol generating article comprises a transfer element downstream of the aerosol-forming substrate, the aerosol-cooling element is preferably downstream of the transfer element.

The aerosol-cooling element may comprise a gathered sheet of material selected from the group consisting of metallic foil, polymeric material, and substantially non-porous paper or cardboard. In certain embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In certain preferred embodiments, the aerosol-cooling element may comprise a gathered sheet of biodegradable polymeric material, such as polylactic acid (PLA) or a grade of Mater-Bi® (a commercially available family of starch based copolyesters).

Preferably, the aerosol generating article comprises a mouthpiece downstream of the aerosol-forming substrate and positioned at the downstream end of the aerosol generating article. The mouthpiece may comprise a filter. For example, the mouthpiece may comprise a filter plug having one or more segments. Where the mouthpiece comprises a filter plug, preferably the filter plug is a single segment filter plug. The filter plug may comprise one or more segments comprising cellulose acetate, paper or other suitable known filtration materials, or combinations thereof. Preferably, the filter plug comprises filtration material of low filtration efficiency.

Aerosol generating articles according to the present invention may comprise a plurality of elements assembled in the form of a rod.

As used herein with reference to the invention, the term "aerosol generating article" is used to denote an article comprising an aerosol-forming substrate that is capable of releasing volatile compounds that can form an aerosol. An aerosol generating article may be a non-combustible aerosol generating article, which is an article that releases volatile compounds without the combustion of the aerosol-forming substrate. An aerosol generating article may be a heated aerosol generating article. As used herein with reference to the invention, the term "heated aerosol generating article" is used herein to denote an aerosol generating article comprising an aerosol-forming substrate that is intended to be heated rather than combusted in order to release volatile compounds that can form an aerosol. A heated aerosol generating article may comprise an onboard heating means forming part of the aerosol generating article, or may be configured to interact with an external heater forming part of a separate aerosol generating device.

The aerosol generating article may be substantially cylindrical in shape. The aerosol generating article may be substantially elongate. The aerosol-forming substrate may be substantially cylindrical in shape. The aerosol-forming substrate may be substantially elongate. The aerosol-forming substrate may be located in the aerosol generating article such that the length of the aerosol-forming substrate is substantially parallel to the airflow direction in the aerosol generating article.

The transfer section or element may be substantially elongate.

The aerosol generating article may have any desired length. For example, the aerosol generating article may have a total length of between approximately 65 millimetres and approximately 100 millimetres. The aerosol generating article may have any desired external diameter. For example, the aerosol generating article may have an external diameter of between approximately 5 millimetres and approximately 12 millimetres.

The aerosol generating article may be circumscribed by an outer wrapper of, for example, cigarette paper, which has low air permeability. This wrapper may be in addition to the retaining wrap of the present invention. Alternatively, where the downstream portion of the retaining wrap extends to the downstream end of the aerosol generating article, the retaining wrap may be used to join all of the components of the aerosol generating article. Where this is the case, the provision of an additional outer wrapper may not be needed.

Alternatively or in addition, the mouthpiece may be circumscribed by tipping paper.

It should also be appreciated that particular combinations of the various features described and defined in any aspects of the invention can be implemented and/or supplied and/or used independently.

The invention will be further described, by way of example only, with reference to the accompanying drawings in which.

Figure 1:
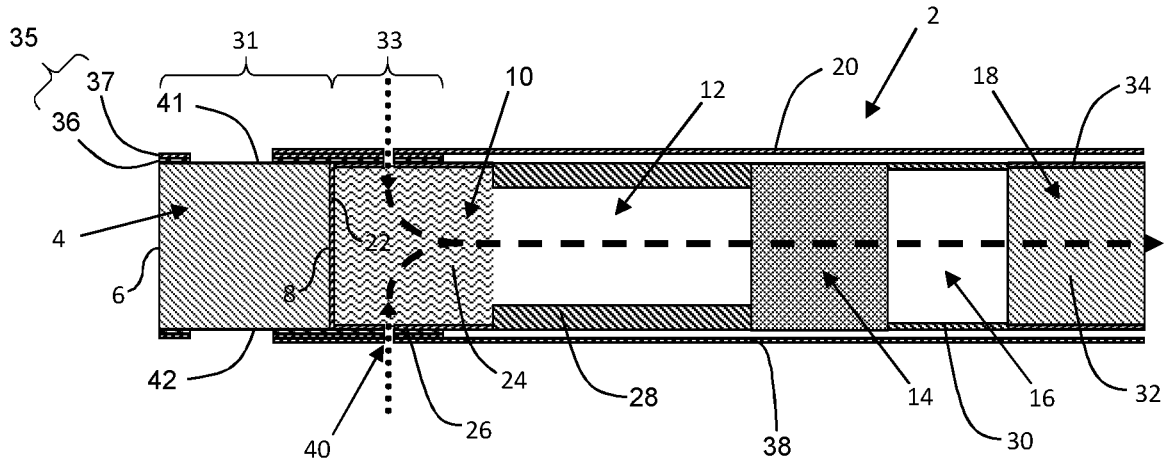
FIG. 1 shows a schematic longitudinal cross-sectional view of an aerosol generating article according to the present invention.

The aerosol generating article 2 according to the first embodiment of the invention is shown in FIG. 1. The aerosol generating article 2 comprises a blind combustible heat source 4 having a front face 6 and an opposed rear face 8, and an aerosol-forming substrate 10. The combustible heat source 4 is substantially cylindrical and comprises a longitudinal outer surface extending between the front face 6 and opposed rear face 8. The aerosol generating article 2 further comprises a transfer element 12 downstream of the aerosol-forming substrate 10, an aerosol-cooling element 14 downstream of the transfer element 12, a spacer element 16 downstream of the aerosol-cooling element 14, and a mouthpiece 18 downstream of the spacer element 16.

The blind combustible heat source 4 is a blind carbonaceous combustible heat source and is located at the upstream end of the aerosol generating article 2. As shown in FIG. 1, a non-combustible substantially air impermeable barrier 22 in the form of a disc of aluminium foil is provided between the rear face 8 of the blind combustible heat source 4 and the aerosol-forming substrate 10. The barrier 22 is applied to the rear face 8 of the blind combustible heat source 4 by pressing the disc of aluminium foil onto the rear face 8 of the blind combustible heat source 4 and abuts the rear face 8 of the combustible carbonaceous heat source 4 and the aerosol-forming substrate 10.

In other embodiments of the invention (not shown), the non-combustible substantially air impermeable barrier 22 between the rear face 8 of the blind combustible heat source 4 and the aerosol-forming substrate 10 may be omitted.

The aerosol-forming substrate 10 is located immediately downstream of the barrier 22 applied to the rear face 8 of the blind combustible heat source 4. The aerosol-forming substrate 10 comprises a cylindrical plug of homogenised tobacco-based material 24 including an aerosol former such as, for example, glycerine, wrapped in plug wrap 26.

The transfer element 12 is located immediately downstream of the aerosol-forming substrate 10 and comprises a cylindrical open-ended hollow cellulose acetate tube 28.

The aerosol-cooling element 14 is located immediately downstream of the transfer element 12 and comprises a gathered sheet of biodegradable polymeric material such as, for example, polylactic acid.

The spacer element 16 is located immediately downstream of the aerosol-cooling element 14 and comprises a cylindrical open-ended hollow paper or cardboard tube 30.

The mouthpiece 18 is located immediately downstream of the spacer element 16. As shown in FIG. 1, the mouthpiece 18 is located at the proximal end of the aerosol generating article 2 and comprises a cylindrical plug of suitable filtration material 32 such as, for example, cellulose acetate tow of very low filtration efficiency, wrapped in filter plug wrap 34.

As shown in FIG. 1, the aerosol generating article 2 further comprises a retaining wrap 35. The retaining wrap 35 comprises an upstream portion 31 which extends the full length of the combustible heat source 4 on the longitudinal outer surface of the combustible heat source 4. The upstream portion 31 of the retaining wrap 35 comprises a first 41 and second 42 opening. The first and second openings 41, 42 pass completely through the retaining wrap 35 to expose a portion of the combustible heat source 4 which the first and second openings 41, 42 overlay. The first and second openings 41, 42 overlay at least about 30 percent of the longitudinal outer surface of the combustible heat source 4. The first and second openings 41, 42 are both the same size and are substantially rectangular. The first and second openings 41, 42 are evenly spaced about the combustible heat source 4. The first and second openings 41, 42 are defined on all sides by the retaining wrap 35, this results in a ring of retaining wrap 35 at the upstream end of the combustible heat source 4. The upstream edge of the first and second openings 41, 42 are disposed about 1 millimetre from the upstream end of the combustible heat source 4 such that the ring of retaining wrap 35 at the upstream end of the combustible heat source 4 is about 1 millimetre long.

The retaining wrap 35 further comprises a downstream portion 33 which circumscribes a portion of the aerosol-forming substrate 10. In the aerosol generating article 2 shown, the retaining wrap 35 circumscribes only a portion of the aerosol-forming substrate 10, extending from the upstream end of the aerosol-forming substrate 10 towards the downstream end of the aerosol-forming substrate 10. However, it will be appreciated that the retaining wrap 35 may circumscribe a larger or smaller amount of the aerosol-forming substrate 10. For example, the retaining wrap 35 may circumscribe the entire longitudinal surface of the aerosol-forming substrate 10.

The retaining wrap 35 comprises a layer of aluminium foil 36 disposed nearest to the combustible heat source 4 and the aerosol-forming substrate 10. The layer of aluminium foil 36 has a thickness of about 20 micrometres. The layer of aluminium foil 36 acts as a heat-conducting element. The retaining wrap 35 further comprises a layer of paper co-laminated with a metal 37. The layer of paper co-laminated with a metal 37 has a thickness of about 50 micrometres. The layer of aluminium foil 36 is attached to the layer of paper co-laminated with a metal 37. The retaining wrap 35 is adhered to the combustible heat source 4 using a silicate glue.

The components of the aerosol generating article 2 are held together by an outer wrapper 20. The outer wrapper 20 extends over a portion of the combustible heat source 4, although it will be appreciated that in other aerosol generating articles 2, the outer wrapper 20 does not extend over the combustible heat source 4.

The aerosol generating article 2 comprises one or more air inlets 40 around the periphery of the aerosol-forming substrate 10.

As shown in FIG. 1, a circumferential arrangement of air inlets 40 is provided in the plug wrap 26 of the aerosol-forming substrate 10, the retaining wrap 35, and the outer wrapper 20 to admit cool air (shown by dotted arrows in FIG. 1) into the aerosol-forming substrate 10.

The multi-segment component 50 may further comprise a removable cap (not shown) at its distal end and directly adjacent to the heat source 4. For example, the removable cap may comprise a central portion including a desiccant, such as glycerine, to absorb moisture as compared to the heat source, which is wrapped in a portion of one or both of the outer wrapper 20 and the wrapper 38 and connected to the rest of that wrapper along a line of weakness comprising a plurality of perforations in the wrapper. In such examples, to use the aerosol generating article, the user removes the removable cap by transversely compressing the cap by pinching it between thumb and finger. By compressing the cap, sufficient force is provided to the line of weakness to locally break the wrapper by which the cap is connected. The user then removes the cap by twisting the cap to break the remaining portion of the line of weakness. When the cap is removed the heat source is partially exposed which enables the user to light the aerosol generating article.

In use, a user ignites the blind combustible heat source 4 of the aerosol generating article 2 according to the first embodiment of the invention and then draws on the mouthpiece 18. When a user draws on the mouthpiece 18, air (shown by dotted arrows in FIG. 1) is drawn into the aerosol-forming substrate 10 of the aerosol generating article 2 through the air inlets 40.

The front portion of the aerosol-forming substrate 10 is heated by conduction through the rear face 8 of the blind combustible heat source 4 and the barrier 22.

Figure 2:
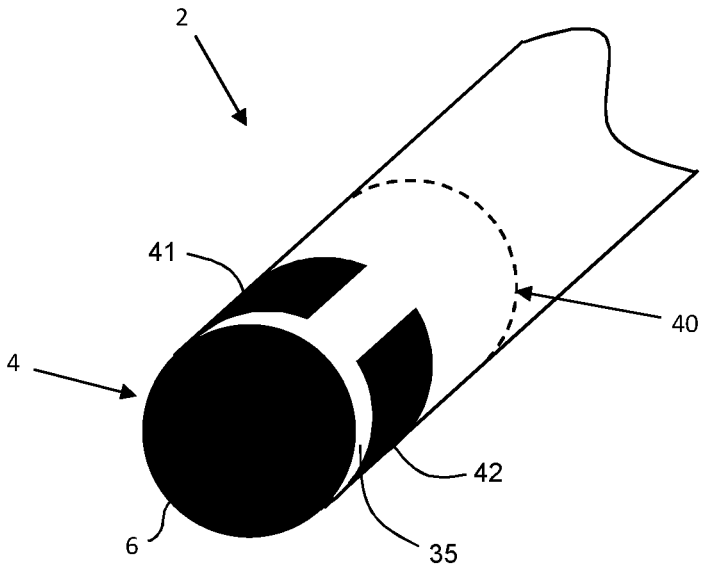
FIG. 2 shows a perspective view of the upstream end of an aerosol generating article according to the present invention.

FIG. 2 is a perspective view of the upstream end of the aerosol generating article shown in FIG. 1. In FIG. 2, the front face 6 of the combustible heat source 4 is clearly exposed. The first and second openings 41, 42 in the retaining wrap 35 are clearly visible, as is the ring of retaining wrap 35 at the upstream end of the combustible heat source. The circumferential arrangement of air inlets 40 is also shown.

Figure 3:
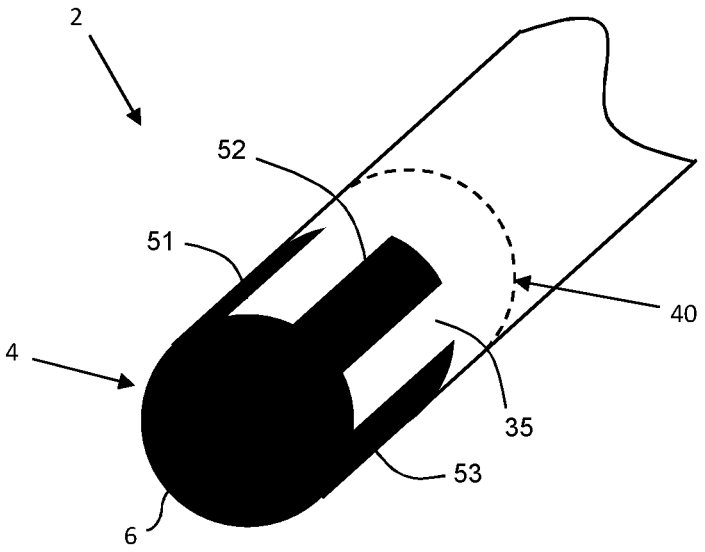
FIG. 3 shows a perspective view of the upstream end of a further aerosol generating article according to the present invention.

FIG. 3 is a perspective view of the upstream end of a further aerosol generating article. It will be appreciated that the aerosol generating article 2 of FIG. 3 includes all of the features described in relation to the aerosol generating article 2 of FIGS. 1 and 2, and differs only in the arrangement of the retaining wrap 35.

The aerosol generating article 2 of FIG. 3 includes a retaining wrap 35. The retaining wrap 35 comprises an upstream portion which extends the full length of the combustible heat source 4 on the longitudinal outer surface of the combustible heat source 4. The upstream portion of the retaining wrap 35 comprises at least a first 51, a second 52, and a third 53 opening. It will be appreciated that the retaining wrap 35 shown in FIG. 3 may include further openings, but that these may not be visible in the perspective view of FIG. 3.

The openings 51, 52, 53 extend to the upstream end of the retaining wrap 35. The openings 51, 52, 53 therefore extend to the upstream end of the combustible heat source 4. Accordingly, the upstream ends of the openings 51, 52, 53 are defined by the upstream edge of the retaining wrap 35. The openings 51, 52, 53 are therefore not fully enclosed by the retaining wrap 35 as is the case in FIG. 2. The retaining wrap 35 therefore comprises a plurality of fingers which extend towards to the upstream end of the combustible heat source 4.

Figure 4:
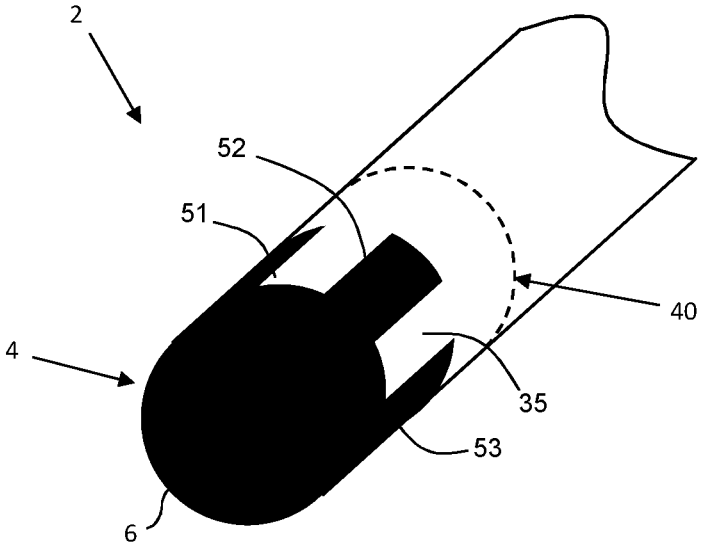
FIG. 4 shows a perspective view of the upstream end of a further aerosol generating article according to the present invention.

FIG. 4 is a perspective view of the upstream end of a further aerosol generating article. It will be appreciated that the aerosol generating article 2 of FIG. 3 includes all of the features described in relation to the aerosol generating article 2 of FIG. 3, and differs only in the arrangement of the retaining wrap 35.

Unlike in FIG. 3, the aerosol generating article 2 of FIG. 4 includes a retaining wrap which does not extend to the upstream end of the combustible heat source. In other words, the upstream end of the upstream portion of the retaining wrap is spaced apart from the upstream end of the combustible heat source.

FIGS. 5 to 9 show schematic plan views of the upstream end of aerosol generating articles according to the present invention. Each of the aerosol generating articles 2 include a retaining wrap 35 comprises an upstream portion which extends the full length of the combustible heat source 4 on the longitudinal outer surface of the combustible heat source 4. The upstream portion of the retaining wrap includes two openings 41, 51, only one of which is visible in each of FIGS. 5 to 9. The second opening, not shown, has the same size and shape as the openings 41, 51 shown and is disposed on the opposite side of the combustible heat source 4.

Figure 6:
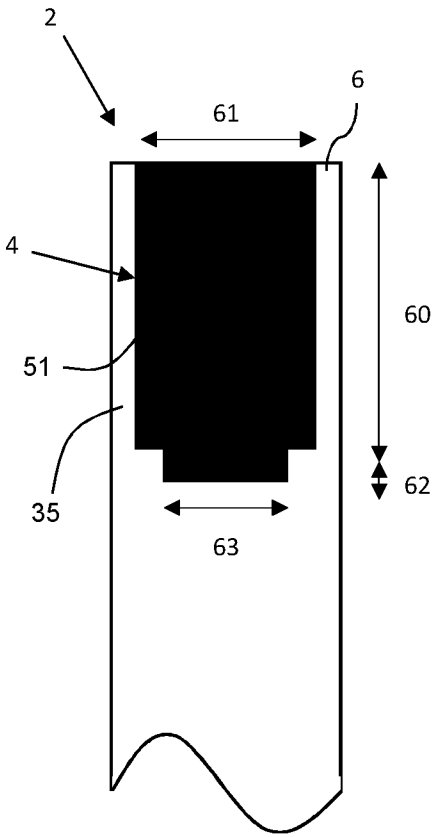
FIGS. 5 to 9 show schematic plan views of the upstream end of aerosol generating articles according to the present invention.
Figure 5:
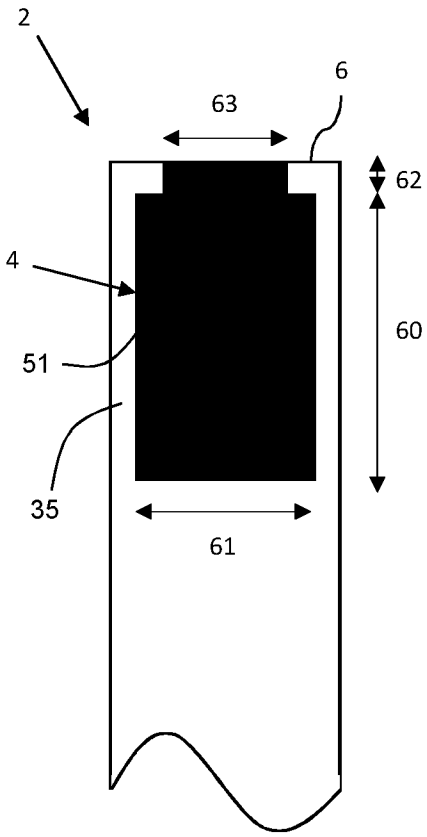

FIGS. 5 and 6 show aerosol generating articles 2 comprising a retaining wrap 35 which include openings 51 which extend all the way to the upstream end of the retaining wrap 35 as is the case in FIG. 3.

The opening 51 shown in FIG. 5 includes a narrow portion at the upstream end of the opening 51. The wider portion of the opening 51 shown in FIG. 4 has a length of 4.5 millimetres (shown by reference numeral 60), and a width of 10 millimetres (shown by reference numeral 61). The narrow portion of the opening 51 has a length of 1.5 millimetres (shown by reference numeral 62), and width of 2 millimetres (shown by reference numeral 63).

The opening 51 shown in FIG. 6 includes a narrow portion at the downstream end of the opening 51. The wider portion of the opening 51 shown in FIG. 6 has a length of 4.5 millimetres (shown by reference numeral 60), and a width of 10 millimetres (shown by reference numeral 61). The narrow portion of the opening 51 has a length of 1.5 millimetres (shown by reference numeral 62), and width of 2 millimetres (shown by reference numeral 63). The area of each of the openings 51 shown in both FIGS. 5 and 6 is 48 millimetres squared. Since each aerosol generating article 2 includes two identical openings 51, the total area of the combustible heat source 4 overlaid by the openings 51 in FIGS. 5 and 6 is 96 millimetres squared. In the aerosol generating articles 2 of FIGS. 5 and 6, the openings 51 in the retaining wrap overlay about 65 percent of the of the longitudinal outer surface of the combustible heat source 4.

Figure 9:
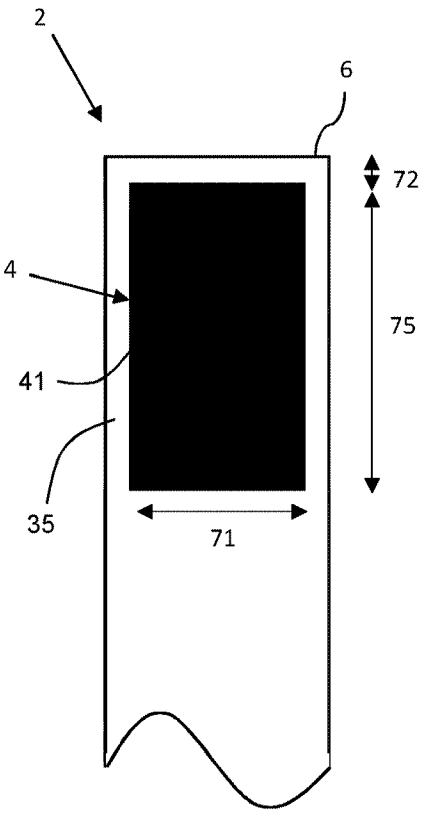
Figure 8:
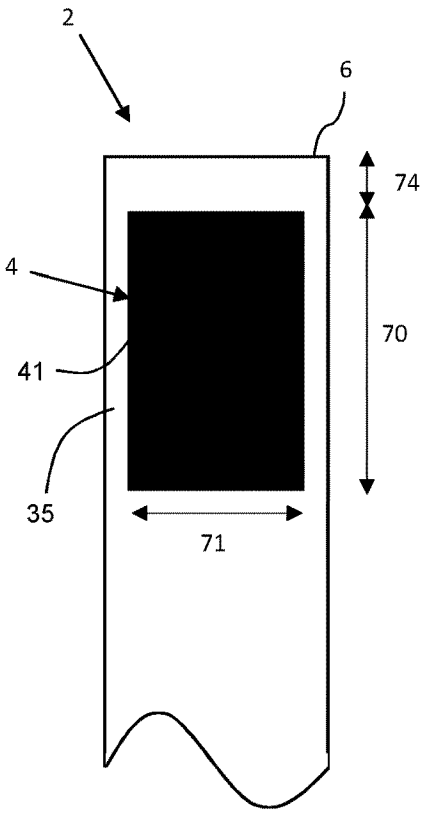
Figure 7:
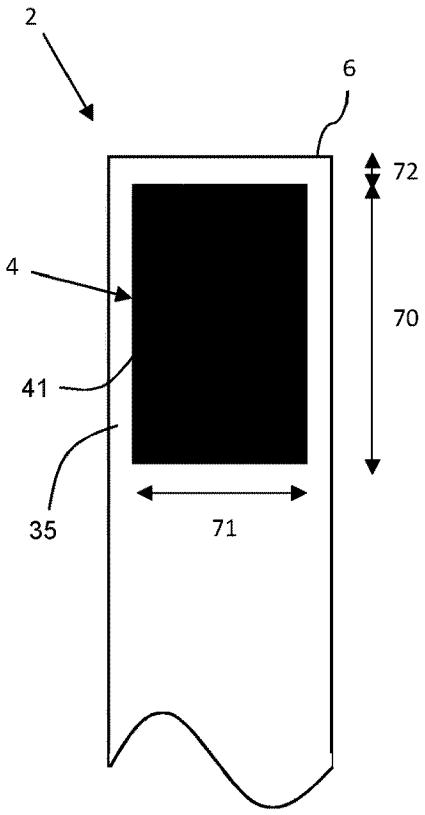

FIGS. 7, 8, and 9 show aerosol generating articles 2 comprising a retaining wrap 35 which include openings 41 which do not extend all the way to the upstream end of the retaining wrap 35, but which are fully defined by the retaining wrap 35 to form a complete ring of retaining wrap 35 at the upstream end of the combustible heat source 4.

The openings 41 shown in both FIGS. 7 and 8 have a length of 4.5 millimetres (shown by reference numeral 70), and a width of 10 millimetres (shown by reference numeral 71).

The area of each of the openings 41 shown in both FIGS. 7 and 8 is 45 millimetres squared. Since each aerosol generating article 2 includes two identical openings 41, the total area of the combustible heat source 4 overlaid by the openings 41 in FIGS. 7 and 8 is 90 millimetres squared. In the aerosol generating articles 2 of FIGS. 7 and 8, the openings 41 in the retaining wrap overlay about 61 percent of the of the longitudinal outer surface of the combustible heat source 4.

The upstream end of the opening 41 of FIG. 7 is disposed 1.5 millimetres from the upstream end of the combustible heat source 4 (shown by reference numeral 72).

The upstream end of the opening 41 of FIG. 8 is disposed 2.5 millimetres from the upstream end of the combustible heat source 4 (shown by reference numeral 74).

The opening 41 shown in FIG. 9 has a length of 5.5 millimetres (shown by reference numeral 75), and a width of 10 millimetres (shown by reference numeral 71).

The area of the opening 41 shown in FIG. 9 is 55 millimetres squared. Since each aerosol generating article 2 includes two identical openings 41, the total area of the combustible heat source 4 overlaid by the openings 41 in FIG. 9 is 110 millimetres squared.

In the aerosol generating article 2 of FIG. 9, the openings 41 in the retaining wrap overlay about 65.8 percent of the of the longitudinal outer surface of the combustible heat source 4.

The upstream end of the opening 41 of FIG. 9 is disposed 1.5 millimetres from the upstream end of the combustible heat source 4 (shown by reference numeral 72).

The aerosol generating articles 2 shown in FIGS. 5, 6, and 7 include openings 41, the downstream ends of which are disposed about 3 millimetres upstream of the downstream end of the combustible heat source.

The aerosol generating articles 2 shown in FIGS. 8 and 9 include openings 41, the downstream ends of which are disposed about 2 millimetres upstream of the downstream end of the combustible heat source.

Figure 10:
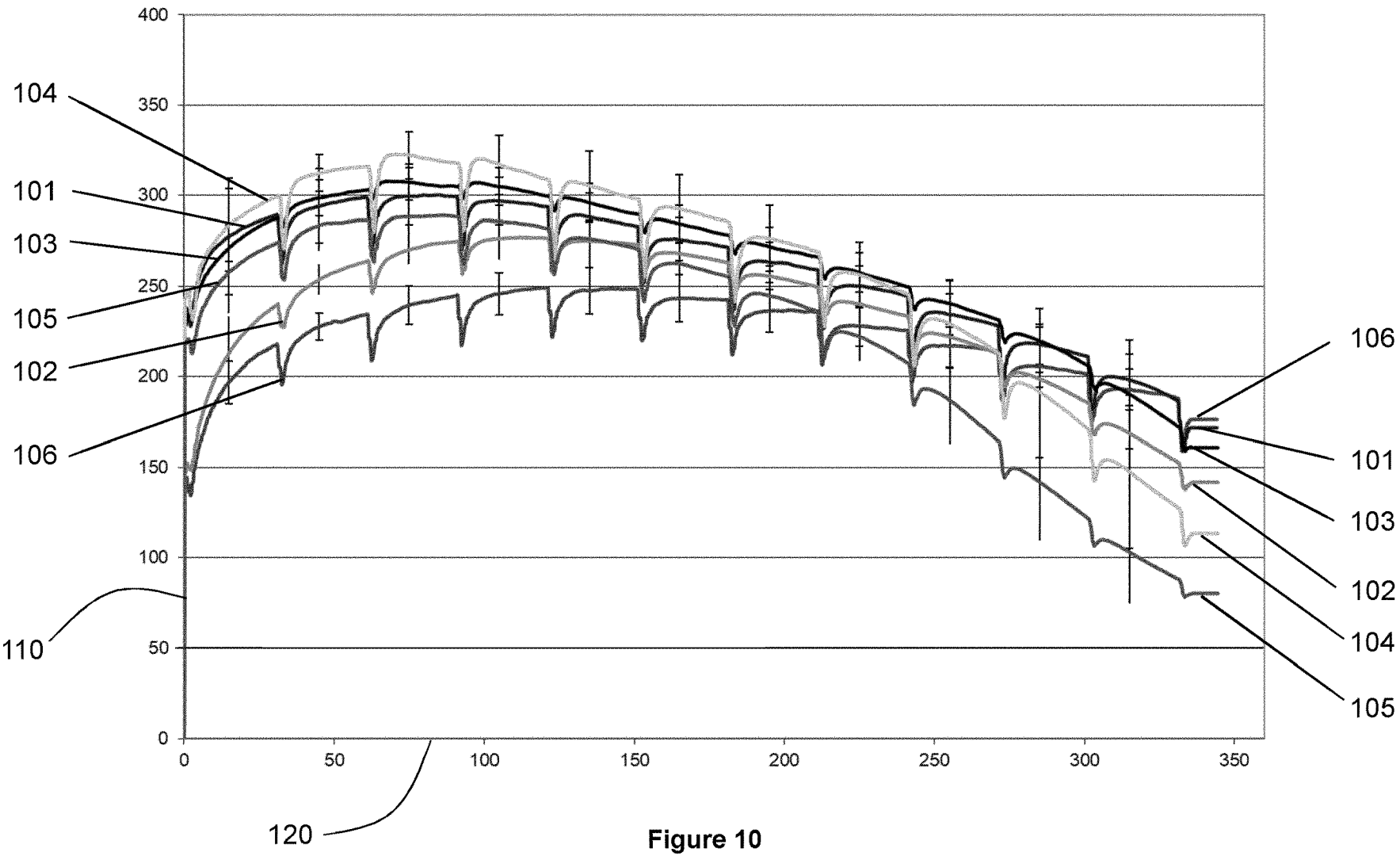
FIGS. 10 to 12 show temperature profiles for various smoking articles, including the smoking articles shown in FIGS. 5 to 9.
Figure 11:
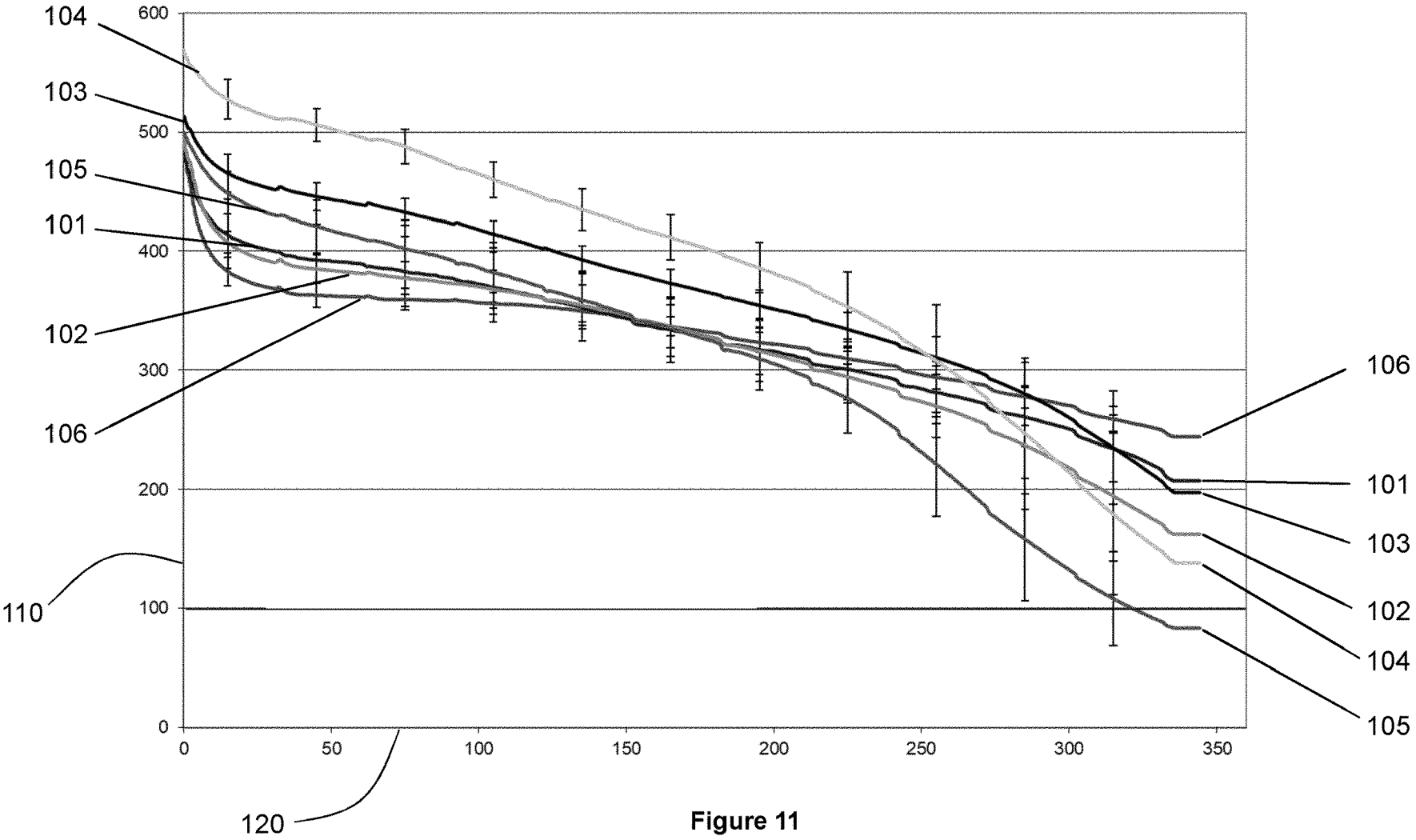
Figure 12:
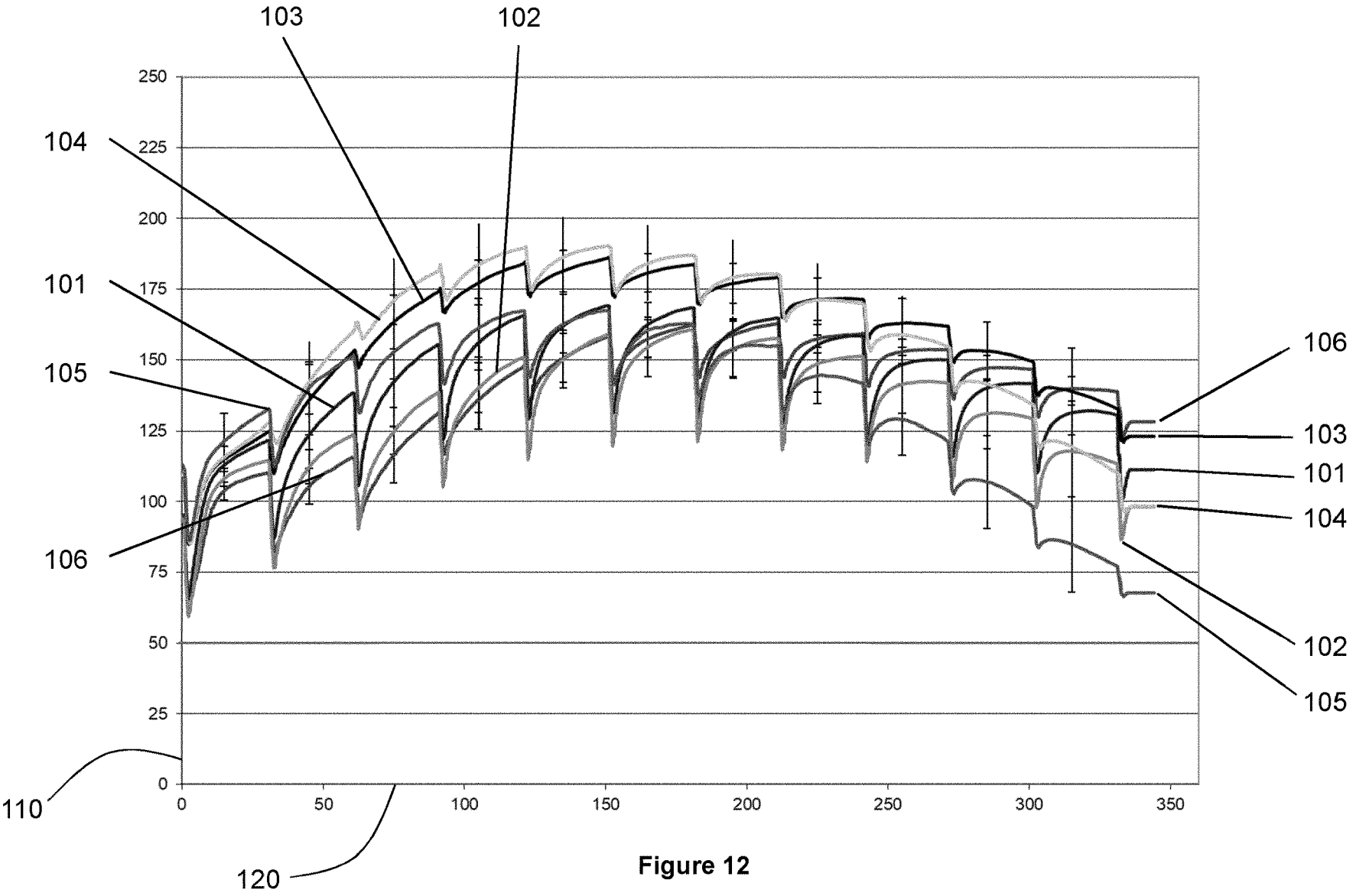

FIGS. 10 to 12 show temperature profiles of aerosol generating articles shown in each of FIGS. 5 to 9, taken at different points in the aerosol generating article.

The smoking articles shown in FIGS. 5 to 9 were manufactured according to the method of the present invention. Each smoking article was held at about 22 degrees Celsius, at about 45 percent relative humidity for 24 hours. The downstream ends of each smoking article were connected to a smoking machine, the combustible heat sources were ignited and each of the aerosol generating articles was subjected to the same puff cycle. The temperature of tobacco plug was measured using a thermocouple throughout the puff cycle to produce temperature profiles showing the temperature of the tobacco plug as a function of time. In the temperature profiles shown in FIGS. 10 to 12, the temperature is shown on the vertical axis 110 and is in degrees Celsius, and time is shown on the horizontal axis and is in seconds.

In the temperature profiles shown in FIGS. 10 to 12, line 101 is the temperature profile for the aerosol generating article shown in FIG. 5, line 103 is the temperature profile for the aerosol generating article shown in FIG. 6, line 104 is the temperature profile for the aerosol generating article shown in FIG. 7, line 104 is the temperature profile for the aerosol generating article shown in FIG. 8, and line 105 is the temperature profile for the aerosol generating article shown in FIG. 9.

A reference aerosol generating article was also tested under the same conditions. The reference aerosol generating article included the same features as those shown in FIGS. 5 to 9. However, the reference aerosol generating article did not include a retaining wrap having an upstream portion extending at least about 50 percent of the way along the length of the combustible heat source on the longitudinal outer surface of the combustible heat source and so was not according to the present invention. As a result, the combustible heat source of the reference aerosol generating article is considerably more exposed than the combustible heat sources of the aerosol generating articles shown in FIGS. 5 to 9. In the temperature profiles shown in FIGS. 10 and 11, line 106 is the temperature profile for the reference aerosol generating article.

FIG. 10 shows temperature profiles measured by a thermocouple in the aerosol generating substrate located about 2 millimetres downstream from the upstream end of the aerosol-forming substrate.

FIG. 11 shows the temperature profiles measured by a thermocouple in the aerosol generating substrate located about 1 millimetre downstream from the upstream end of the aerosol-forming substrate.

FIG. 12 shows the temperature profiles measured by a thermocouple in the aerosol generating substrate located about 7 millimetres downstream from the upstream end of the aerosol-forming substrate.

As can be seen from the temperature profiles shown in FIGS. 10 to 12, the temperature profiles of the aerosol generating articles shown in FIGS. 5 to 9 are similar to the temperature profiles for the reference aerosol generating article. Moreover, in all of FIGS. 10 to 12, the aerosol-forming substrates of the aerosol generating articles shown in FIGS. 5 to 9 are actually at a higher temperature than the aerosol-forming substrate of the reference aerosol generating article at least until about 200 seconds into the puff cycle. The maintenance of a high temperature in the aerosol-forming substrate is associated with improved generation of aerosol. The maintenance of a high temperature at the later time periods in the graph is associated with improved duration of aerosol generation from the aerosol generating substrate. Therefore, surprisingly it was found that the provision of a retaining wrap having an upstream portion extending at least about 50 percent of the way along the length of the combustible heat source on the longitudinal outer surface of the combustible heat source did not have a substantial negative effect of the performance of the combustible heat source such that the combustible heat source rendered non-functional the aerosol generating article.

Additionally, FIG. 12 shows that even at the far downstream end of the aerosol-forming substrate, at 7 millimetres from the upstream end of the aerosol-forming substrate, the aerosol generating articles of the present invention maintain similar temperatures to those of the reference aerosol generating article 106. This is particularly advantageous since it demonstrates that the aerosol-forming substrates of the present invention are being heated along their full length allowing aerosol to be generated over a high proportion of the aerosol-forming substrate.

Furthermore, it was concluded that of the aerosol generating articles shown in FIGS. 5 to 9, the aerosol generating article shown in FIG. 5, with the temperature profile shown by line 101, performed best. As can be seen from FIGS. 10 to 12, the aerosol forming substrate of the aerosol generating article shown in FIG. 5 was able to maintain the highest temperature for the longest time. In particular, both FIGS. 10 to 12 show that the temperature of the aerosol-forming substrate of the aerosol generating article shown in FIG. 5 is surprisingly higher at the end of the puff cycle than the temperatures the aerosol-forming substrates of the other aerosol generating articles according to the present invention.

There is also provided a method for manufacturing an aerosol generating article. The method comprises providing a length of paper. The paper is a paper co-laminated with a metal. In some embodiments, a patch of aluminium foil is then added to the paper. At least one opening is then cut through the aluminium patch and the paper to form a retaining wrap. The at least one opening is forms using a stamping process. The material (paper and aluminium foil) defined by the cut line is removed to form the opening. The retaining wrap is then applied to a combustible heat source and an aerosol-forming substrate such that an upstream portion of the retaining wrap extends at least about 50 percent of the way along the length of the combustible heat source on the longitudinal outer surface of the combustible heat source, the at least one opening being in the upstream portion of the retaining wrap, and a downstream portion of the retaining wrap circumscribes at least a portion of the aerosol-forming substrate.

The specific embodiments and examples described above illustrate but do not limit the invention. It is to be understood that other embodiments of the invention may be made and the specific embodiments and examples described herein are not exhaustive.

The invention claimed is:

1. An aerosol generating article comprising:

a combustible heat source having a longitudinal outer surface;

an aerosol-forming substrate downstream of the combustible heat source; and a retaining wrap comprising:

an upstream portion extending at least about 50 percent of the way along the length of the combustible heat source on the longitudinal outer surface of the combustible heat source, and comprising at least one opening, the at least one opening overlaying at least about 30 percent of the longitudinal outer surface of the combustible heat source such that the at least one opening allows the combustible heat source to be ignited by heat passing through the at least one opening to the combustible heat source, and a downstream portion circumscribing at least a portion of the aerosol-forming substrate, wherein the upstream portion of the retaining wrap is adhered to the surface of the combustible heat source using an adhesive.

2. The aerosol generating article according to claim 1, wherein the upstream portion of the retaining wrap extends to the upstream end of the combustible heat source, or extends beyond the upstream end of the combustible heat source.

3. The aerosol generating article according to claim 1, wherein the at least one opening of the upstream portion of the retaining wrap has a total area of at least about 45 millimetres squared.

4. The aerosol generating article according to claim 1, wherein the retaining wrap comprises a metallic foil.

5. The aerosol generating article according to claim 1, wherein the retaining wrap comprises paper.

6. The aerosol generating article according to claim 5 wherein the paper comprises at least one of paper co-laminated with a metal or metalized paper.

7. The aerosol generating article according to claim 1, wherein the retaining wrap has a maximum thickness of no more than about 190 micrometres.

8. The aerosol generating article according to claim 1, wherein the at least one opening in the retaining wrap comprises an opening surrounded on all sides by the retaining wrap.

9. The aerosol generating article according to claim 8, wherein the upstream edge of the at least one opening is disposed at least about 1 millimetre from the upstream end of the combustible heat source.

10. The aerosol generating article according to claim 1, wherein the at least one opening extends to the upstream end of the retaining wrap such that the at least one opening in the retaining wrap is not surrounded on all sided by the retaining wrap.

11. The An aerosol generating article according to claim 1, wherein the upstream portion of the retaining wrap extends to the upstream end of the combustible heat source, the retaining wrap comprising both metallic foil, and paper co-laminated with a metal or metalized paper, and the at least one opening overlays between about 50 percent and about 90 percent of the longitudinal outer surface of the combustible heat source.

12. A method for forming an aerosol generating article, the method comprising:

providing a combustible heat source and an aerosol-forming substrate, providing a portion of wrapping material, cutting at least one opening in the portion of wrapping material to form a retaining wrap, applying the retaining wrap to the combustible heat source and the aerosol-forming substrate and adhering an upstream portion of the retaining wrap to the surface of the combustible heat source using an adhesive such that, the upstream portion of the retaining wrap extends at least about 50 percent of the way along the length of the combustible heat source on the longitudinal outer surface of the combustible heat source, the at least one opening being in the upstream portion of the retaining wrap, the at least one opening overlays at least about 30 percent of the longitudinal outer surface of the combustible heat source such that the at least one opening allows the combustible heat source to be ignited by heat passing through the at least one opening to the combustible heat source, and a downstream portion of the retaining wrap circumscribes at least a portion of the aerosol-forming substrate.

13. The method according to claim 12, wherein the step of providing a portion of wrapping material comprises:

providing a portion of paper co-laminated with a metal, or metallized paper;

providing a portion of metallic foil; and affixing the portion of metallic foil to the portion of paper.

14. The method according to claim 13, wherein the step of cutting at least one opening in the portion of wrapping material comprises cutting a single opening through both;

the portion of paper co-laminated with a metal, or metallized paper, and the portion of metallic foil.

* * * * *